US011092343B2

(12) United States Patent
Raghavan et al.

(10) Patent No.: US 11,092,343 B2
(45) Date of Patent: Aug. 17, 2021

(54) ZERO CLEARANCE COMBINATION OVEN

(71) Applicant: Alto-Shaam, Inc., Menomonee Falls, WI (US)

(72) Inventors: J. K. Raghavan, Mequon, WI (US); Robert Simmelink, Shorewood, WI (US); Janus Bartelick, Germantown, WI (US)

(73) Assignee: Alto-Shaam, Inc., Menomonee Falls, WI (US)

( * ) Notice: Subject to any disclaimer, the term of this patent is extended or adjusted under 35 U.S.C. 154(b) by 277 days.

(21) Appl. No.: 15/971,066

(22) Filed: May 4, 2018

(65) Prior Publication Data

US 2018/0252415 A1 Sep. 6, 2018

Related U.S. Application Data

(63) Continuation of application No. 13/868,418, filed on Apr. 23, 2013, now Pat. No. 10,281,156.

(51) Int. Cl.

| | |
|---|---|
| ***F24C 15/00*** | (2006.01) |
| ***F24C 13/00*** | (2006.01) |
| ***F24C 3/00*** | (2006.01) |

(52) U.S. Cl.

CPC ..... *F24C 15/006* (2013.01); *F24C 3/004* (2013.01); *F24C 13/00* (2013.01)

(58) Field of Classification Search

CPC ..... F24C 7/087; F24C 15/355; F24C 15/35; F24C 3/004; F24C 13/00; F24C 15/006; F24C 1/00; F24C 3/027; F24C 15/32; F24C 15/322; F24C 15/34; F24C 15/325; F24C 15/327; F24C 15/20; F24C 15/2042; F24C 15/2007; A47J 37/0623; A47J 39/003; A47J 27/04; A47J 39/00; A21B 3/04; A21B 1/245; A21B 1/10; H05B 6/6473; H05B 6/6476; H05B 6/6479; H05B 6/6485; H05B 6/6402; H05B 6/6405; H05B 6/645; H05B 6/6482; H05B 6/80; H05B 6/6423; H05B 6/6429; H05B 6/642; F22B 35/02; F24B 7/00; F26B 3/02; B65D 2581/3466; B65D 2581/3472; B65D 2581/3494; B65D 81/3446; B65D 81/3453; F21V 3/005; F21V 29/506; F21K 9/27; F21K 9/90; F21Y 2103/10; F21Y 2115/10

USPC ..... 219/678–763, 385–553; 126/273 R, 126/19 R, 20, 21 R, 21 A, 15 R–15 A, 126/299 D, 299 R, 300, 301, 302, 303, 126/1 F; 362/100–101, 551–582, 218, 362/92–94, 217.01–217.17, 227–249.19, (Continued)

(56) References Cited

U.S. PATENT DOCUMENTS 3,654,417 A * 4/1972 Javes ..... H05B 6/642 219/757
4,158,431 A * 6/1979 Van Bavel ..... H05B 6/6482 340/309.4

(Continued)

*Primary Examiner* — Ibrahime A Abraham
*Assistant Examiner* — Gyounghyun Bae
(74) *Attorney, Agent, or Firm* — Boyle Fredrickson S.C.

(57) ABSTRACT

A commercial oven, such as a combination oven providing steam and convection heating, may provide an equipment cabinet holding electronic equipment and having an external wall abutting other heating apparatus. The external wall includes an interior plenum through which air is circulated to provide compact virtual insulation from external heat sources.

16 Claims, 9 Drawing Sheets

(58) Field of Classification Search
USPC ..... 362/255–256, 362–375, 382–456; 99/324–400, 401–402, 403–418, 426–427; 454/339
See application file for complete search history.

(56) References Cited

U.S. PATENT DOCUMENTS 4,327,274 A * 4/1982 White ..... F24C 15/2042 126/198
4,436,356 A * 3/1984 Stelling ..... H05B 6/6402 108/93
4,455,467 A * 6/1984 Dills ..... F24C 15/16 219/732
4,834,063 A * 5/1989 Hwang ..... A21B 1/245 126/21 A
4,972,824 A * 11/1990 Luebke ..... A21B 1/245 126/21 A
5,042,458 A * 8/1991 Spencer ..... F24C 15/2042 126/299 R
5,204,503 A * 4/1993 Maiellano, Jr. ..... F24C 7/06 219/400
5,401,940 A * 3/1995 Smith ..... A21B 1/245 219/679
5,866,886 A * 2/1999 Lange ..... F24C 15/20 126/21 A
5,981,929 A * 11/1999 Maeda ..... H05B 6/6429 126/299 D
6,433,324 B1 * 8/2002 Kim ..... H05B 6/6423 126/21 A
7,087,875 B2 * 8/2006 Cho ..... H05B 6/6429 219/756
9,532,408 B2 * 12/2016 Asami ..... H05B 6/642
2002/0084265 A1 * 7/2002 Ahn ..... H05B 6/6426 219/756
2002/0190063 A1 * 12/2002 Lee ..... H05B 6/6423 219/757
2005/0006382 A1 * 1/2005 Hayakawa ..... F24C 15/327 219/682
2005/0236389 A1 * 10/2005 Goranson ..... A21B 1/245 219/400
2006/0237425 A1 * 10/2006 Kim ..... F24C 15/2007 219/400
2007/0102426 A1 * 5/2007 Braunisch ..... H05B 6/6423 219/757
2007/0114222 A1 * 5/2007 Shon ..... A21B 3/04 219/401
2008/0185373 A1 * 8/2008 Elkasevic ..... F24C 15/006 219/394
2008/0190911 A1 * 8/2008 Adamski ..... F24C 14/00 219/400
2009/0013988 A1 * 1/2009 Kim ..... H05B 6/6476 126/21 A
2009/0188915 A1 * 7/2009 Noda ..... A21B 1/245 219/757
2009/0194092 A1 * 8/2009 Shon ..... F24C 15/327 126/273 R
2010/0276414 A1 * 11/2010 Nam ..... F24C 15/16 219/392
2011/0215091 A1 * 9/2011 Stanger ..... H05B 6/6479 219/682
2012/0079948 A1 * 4/2012 Nam ..... H05B 6/6476 99/331
2012/0125911 A1 * 5/2012 Shaffer ..... F24C 15/008 219/393

* cited by examiner

ZERO CLEARANCE COMBINATION OVEN

CROSS REFERENCE TO RELATED APPLICATIONS

This application is a continuation of U.S. patent application Ser. No. 13/868,418, filed Apr. 23, 2013, and hereby incorporated by reference.

BACKGROUND OF THE INVENTION

The present invention relates to commercial ovens and in particular to an oven that may be placed closely adjacent to other heating devices.

Commercial ovens may include features such as forced and heated airflow through the cooking cavity (convection cooking) and the introduction of steam into the cooking cavity (steam cooking). The fan motor for convection cooking, the water handling system for steam cooking, and control electronics for each are normally held in an equipment compartment that is maintained at a substantially lower temperature than the cooking cavity compatible with electrical and electromechanical components.

The equipment compartment is normally adjacent to the cooking cavity to provide for the necessary mechanical and electrical connections between equipment of the equipment compartment and the fan, steam nozzles, and sensors within the cooking cavity. This close proximity results in substantial heat transfer from the cooking cavity and the electrical compartment which, if unaddressed, would unacceptably raise the temperature of the equipment compartment. For this reason, the equipment compartment normally includes one or more cooling fans pulling cool air from outside of the oven housing to pass through the equipment compartment.

The ability to properly cool the equipment compartment with external air is founded on some assumptions about the environment of the oven including assumptions about the temperature of the air being drawn into the oven and assumptions that the primary heat entering the equipment compartment comes from the oven cavity and internally generated heat from the electrical and electromechanical components. These assumptions are normally enforced by requiring that the oven have a minimum clearance distance from other equipment that may present a source of radiated or conducted heat or heated air that could cause the local environment of the equipment compartment to rise beyond the expected normal range.

Providing this clearance in environments where space is scarce and/or enforcing the observation of this clearance in all oven installations can be difficult.

SUMMARY OF THE INVENTION

The present invention provides an oven with a "zero clearance" outer wall having an internal air circulation plenum just inside the outer wall. By providing forced airflow through the plenum, the plenum internalizes otherwise necessary external clearance distances but with a thickness that can be less than that required external clearance distance as a result of the airflow effect. The plenum system can eliminate or reduce passive thermal insulation that might otherwise be required allowing improved access to the equipment compartment.

Specifically, in one embodiment, the present invention provides an oven having a housing providing an oven compartment and an adjacent equipment compartment each having a shared wall and independent outer vertical walls. A heater communicates with the oven compartment to preferentially heat the oven compartment for cooking food, and electronic equipment for the operation of the oven is held in the equipment compartment. A plenum is attached to an inner surface of the outer vertical wall of the equipment compartment to promote a flow of air along the inner surface of the outer vertical wall as part of a path from an intake point outside of the housing to an exit point outside of the housing.

It is thus a feature of at least one embodiment of the invention to provide a compact virtual insulation inside the outer wall of the equipment compartment permitting the oven to be placed against other equipment that may also generate heat.

The air intake point may be located at a bottom of the housing and the air exit point may be located at the top of the housing.

It is thus a feature of at least one embodiment of the invention to promote airflow using natural convection and to take advantage of the typical favorable air temperature differences and flow patterns within a kitchen.

The oven may include a fan for drawing air into the housing and through the plenum.

It is thus a feature of at least one embodiment of the invention to provide an extremely thin plenum through the use of forced airflow.

The fan may separately circulate air through the plenum and the equipment compartment.

It is thus a feature of at least one embodiment of the invention to take advantage of an existing cooling fan used to cool the equipment compartment to also supply air to the plenum.

The oven may include airflow restrictors interfacing with the plenum for guiding air through the plenum.

It is thus a feature of at least one embodiment of the invention provide a simple method to control a ratio of airflow into separate paths through the equipment cabinet and the plenum from a single fan.

The fan may be located near the bottom of the housing to draw air into the housing and the oven may further include a second fan located near the top of the housing to exhaust air out of the top of the housing.

It is thus a feature of at least one embodiment of the invention to provide improved control of airflow through the equipment compartment and plenum through the use of paired intake and exhaust fans.

The oven may further include a third fan located near a front top of the housing to draw air into the housing wherein the second fan is positioned near the rear of the housing.

It is thus a feature of at least one embodiment of the invention to promote a rearward exhausting away from the user and dilution of that discharged air.

The outer vertical wall of the equipment compartment may be removable for access to the equipment compartment by releasable fasteners and the plenum may be a sheet attached to and spaced from an inner surface of the outer vertical wall covering substantially the entire inner surface of the outer vertical wall.

It is thus a feature of at least one embodiment of the invention to provide the benefits of the plenum described above without substantially impeding access to the equipment cabinet necessary for maintenance and repair.

The outer vertical wall of the equipment compartment may be a metal sheet and the plenum may be welded to an inner surface of the outer vertical wall.

It is thus a feature of at least one embodiment of the invention to provide a simple plenum structure that may attach to the outer vertical wall for easy removal of the two in unison.

The plenum may have additional heat limiting insulation added to the innermost wall of the plenum or to the outer wall of the oven or between the electronic equipment and the outer wall to provide even greater heat resistance without restricting the air flow through the plenum.

It is thus a feature of at least one embodiment of the invention to permit augmentation of the virtual insulation of the plenum with insulation to provide a flexible trade-off between plenum size and airflow rate and heat resistance.

In some embodiments, however the invention also contemplates that the outer wall of the oven an inner wall of the plenum and that nonstructural insulation may be eliminated between the electronic equipment and the outer wall.

It is thus a feature of at least one embodiment of the invention to make use of the virtual insulation without additional insulation in the plenum to eliminate the need for separate passive insulation that may block ready access to the equipment of the equipment compartment and use valuable equipment compartment volume.

The equipment compartment may include a motor providing a fan for circulating air in the oven cavity or may include plumbing and an electronically controlled valve for controlling water for the generation of steam in the oven cavity, and/or an electronic computer.

It is thus a feature of at least one embodiment of the invention to provide an equipment compartment that is sufficiently cool to hold the elements necessary for convection and steam cooking.

These particular objects and advantages may apply to only some embodiments falling within the claims and thus do not define the scope of the invention.

DETAILED DESCRIPTION OF THE PREFERRED EMBODIMENT

Zero Clearance Sidewall

Figure 1:
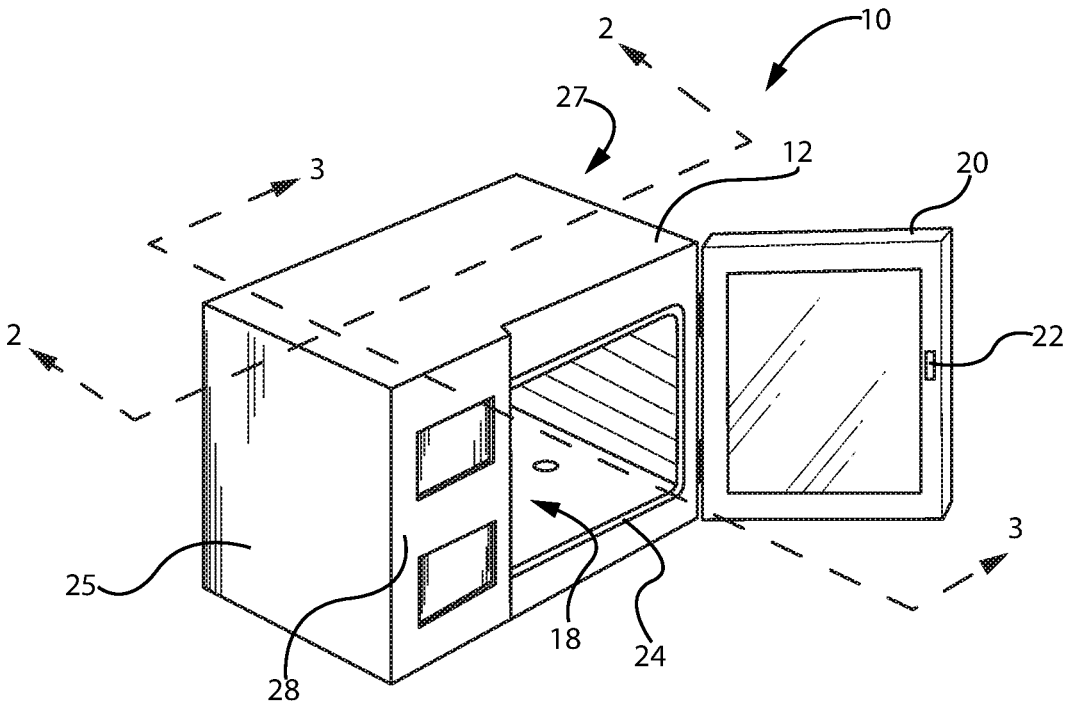
FIG. 1 is a simplified perspective view of a combination oven suitable for use with the present invention showing a housing having an openable door revealing a cooking cavity and showing a user-accessible control panel on a front surface of the oven in front of an equipment compartment.

Referring now to FIG. 1, a "zero clearance" oven 10 according to one embodiment of the present invention may provide an oven housing 12 internally divided into an oven compartment 14 and an equipment compartment 16.

The oven compartment 14, in turn, holds an oven cavity 18 that may be accessed through a door 20, the latter connected by a hinge at one vertical side of the oven cavity 18. As is generally understood in the art, the door 20 may close over the oven cavity 18 during cooking operation as held by a latch assembly 22 (visible on the door 20 only). In the closed position, the door 20 may substantially seal against the oven cavity 18 by compressing against a gasket 24 surrounding an opening of the oven cavity 18 in the housing 12. Sidewalls of the oven cavity 18 may provide for rack supports 11 holding conventional cooking racks for supporting pans or trays of food.

The equipment compartment 16 is positioned to the side of the oven compartment 14 and supports on a front exposed wall of the equipment compartment 16 a control panel 28 accessible by a user standing at a front of the oven 10. The control panel 28 may provide conventional electronic controls such as switches, buttons, a touchscreen or the like that may receive oven control data from the user as will be described below. The equipment compartment 16 further has an external vertical sidewall 25 not shared with the oven compartment 14 (generally to the left sidewall of the oven 10 as depicted in FIG. 1) while the oven compartment 14 also provides one external vertical sidewall 27 generally opposite to the sidewall 25. The outer walls of the oven compartment 14 may be insulated with a glass fiber materials 26 or the like.

Figure 2:
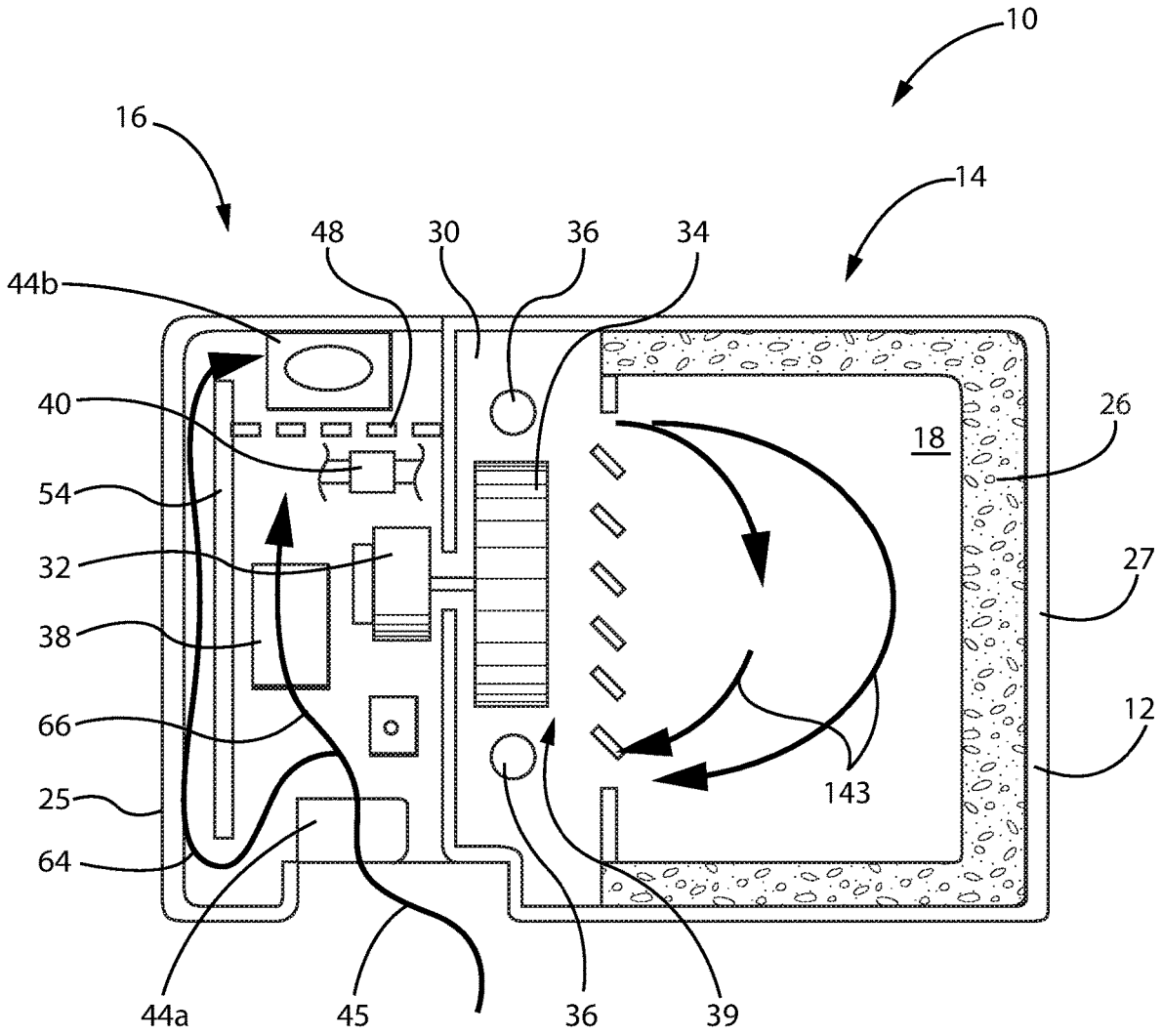
FIG. 2 is a section along line 2-2 of FIG. 1 showing the adjacent cooking cavity and equipment compartment, the latter including a lower air intake fan and upper air intake and exhaust fans.

Referring now to FIG. 2, the oven compartment 14 and the equipment compartment 16 may share and be opposed across a common divider wall 30 substantially separating the two compartments and normally parallel to but spaced between sidewalls 25 and 27. An electric motor 32 may be positioned on one side of the divider wall 30 in the equipment compartment 16 to communicate with a convection fan 34 positioned on the other side of the divider wall 30 within the oven cavity 18. When rotating, convection fan 34 may direct a stream of air 142 across a heater 36 into the oven cavity 18 to accelerate cooking.

A heater 36 may be positioned adjacent to and surrounding the convection fan 34 to heat the air 142 discharged from the convection fan 34. The heater 36 may be an electric heating element holding electrical resistance element or a tubular heat exchanger receiving flue gases from a gas flame or the like.

In some embodiments, steam may be introduced into the oven cavity 18 as produced by a water jet 39 directing a spray of water on the convection fan 34 and/or heater 36 proximate to the fan 34. The supporting plumbing and an electrically controlled valve 40 for control of the water jet 39 may be placed in the equipment compartment 16. Alternatively steam may be provided by a separate boiler 21 having a dedicated heater element 23 and communicating with the oven cavity 18. In this case, the heater elements and tank filling valves and plumbing of this boiler may be controlled by circuitry within the equipment compartment 16.

An electronic control circuit 38 may be positioned within the equipment compartment 16 communicating with the control panel 28 (shown in FIG. 1) to receive cooking instructions from a user and provide control of the motor 32, the valve 40 and other electronic components to be described below. The electronic control circuit 38 may hold, for example, a microprocessor for executing a program held in a stored memory.

Ovens of this type are commercially available from the Alto-Shaam Inc. of Menomonee Falls, Wis. and are described generally in U.S. Pat. No. 6,188,045 "Combination Oven with Three Stage Water Atomizer" hereby incorporated by reference.

Figure 3:
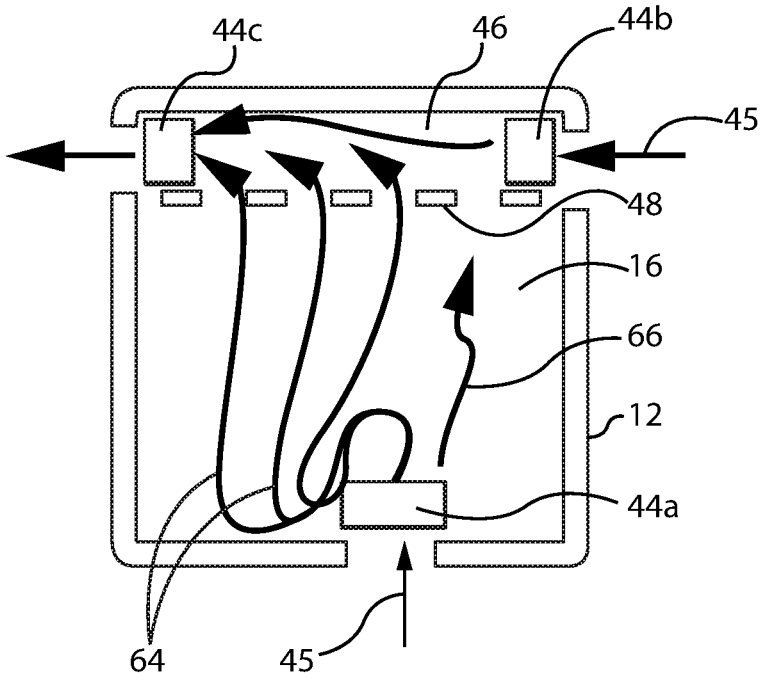
FIG. 3 is a cross-section along line 3-3 of FIG. 1 showing the displacement of the upper air intake and exhaust fans at the front and rear of the equipment compartment respectively.

Referring now to FIGS. 2 and 3, the equipment compartment 16 may be cooled by multiple fans 44*a*, 44*b*, and 44*c*. Fan 44*a* is positioned at the bottom of the equipment compartment 16 to provide for the intake of fresh air 45 from beneath the housing 12 and to direct that air upward into the equipment compartment 16. In contrast, fan 44*b* may be positioned at a front upper edge of the equipment compartment 16 to draw in fresh air 45 from that location to pass horizontally backward through the equipment compartment 16 in a scavenger channel 46 to exhaust fan 44*c*. The exhaust fan 44*c* may be positioned at a rear upper edge of the equipment compartment 16 to expel the air from the scavenger channel 46 out the rear of the housing 12. Generally, the scavenger channel 46 is separated from a remaining portion of the equipment compartment 16 by a restrictor plate 48 providing a set of perforations through which air may flow from a lower portion of the equipment compartment 16 into the scavenger channel 46 to be expelled therefrom. The operation of the restrictor plate 48 will be discussed below.

Figure 4:
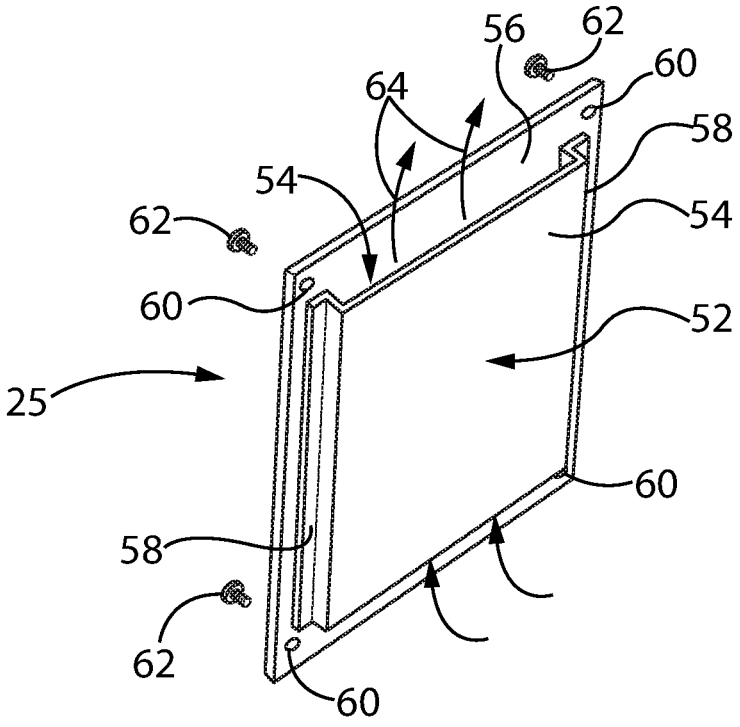
FIG. 4 is a perspective view of a vertical sidewall of the equipment compartment removed from the equipment compartment and showing an attached plenum formed of a single sheet of metal attached to an interior surface of the vertical sidewall.
Figure 5:
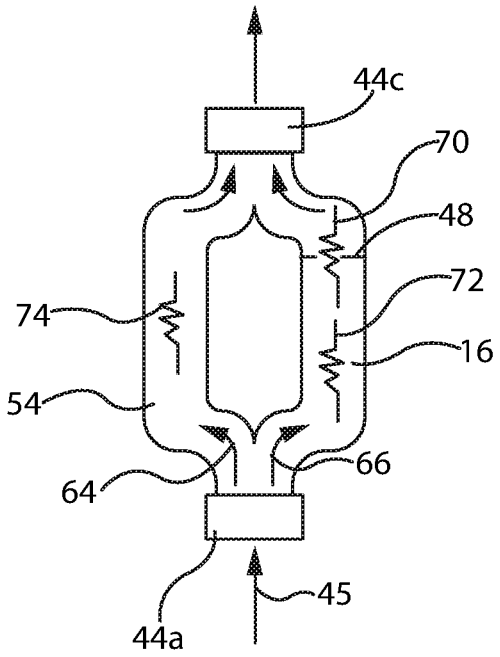
FIG. 5 is an airflow resistance diagram showing use of flow restrictors to control the airflow into the plenum.

Referring now to FIG. 4, the outer sidewall 25 of the equipment compartment 16 may provide for a first outer panel 50 forming the outer surface of the outer sidewall 25, for example, constructed of a planar sheet of stainless steel. On an inner surface of the outer panel 50, facing the equipment compartment 16, a plenum 52 may be formed offering a thin plenum channel 54 between the plenum 52 and the outer panel 50 for airflow across substantially the entire surface of the outer panel 50. The plenum channel 54 may be provided by a substantially planar plenum sheet 56 parallel to and spaced from the inner surface of the outer panel 50, for example, by approximately ½ inch. The plenum sheet 56 may have vertical left and right flanges 58 that extend toward the outer panel 50 and may be spot welded thereto so that the plenum sheet 56 is attached to the outer panel 50. Outer panel 50 may include holes 60 receiving machine screws 62 or other similar releasable fasteners that may pass through the outer panel 50 to attach it to the remainder of the housing 12 by conventional means so that the outer panel 50 may be attached or removed for access to the equipment compartment 16.

Referring now to FIGS. 2, 3, 5 and 6, airflow from fan 44*a* may be split into a plenum stream 64 and an equipment stream 66, with the plenum stream 64 passing through the plenum channel 54 between the plenum sheet 56 and the outer panel 50 and the equipment stream 66 bypassing the plenum channel 54 and flowing directly over the electrical equipment within the equipment compartment 16 including the control circuit 38, the motor 32, and the valve 40. The plenum stream 64 bypasses the restrictor plate 48 to be directly received within the scavenger channel 46 while the equipment stream 66 must pass through the restrictor plate 48.

In this respect, the restrictor plate 48 allows for balancing the plenum stream 64 and equipment stream 66 by adding a flow resistance 70 experienced only by the equipment stream 66. The flow resistance 70 sums with a general equipment resistance 72 caused by air resistance experienced by the equipment stream 66 in passing over the electrical equipment outside of the plenum channel 54. In contrast, the plenum stream 64 experience is only a resistance 74 associated with the plenum 52 and the path into and out of the plenum channel 54 that avoids the restrictor plate 48. It will thus be seen that the restrictor plate 48 may be adjusted to control the airflow through the plenum channel 54 under the principle that additional airflow in the plenum stream 64 occurs when resistance 70 increases. In this way a single set of fans 44 also used for cooling equipment compartment 16 may be enlisted in creating the airflow through the plenum channel 54.

Figure 6:
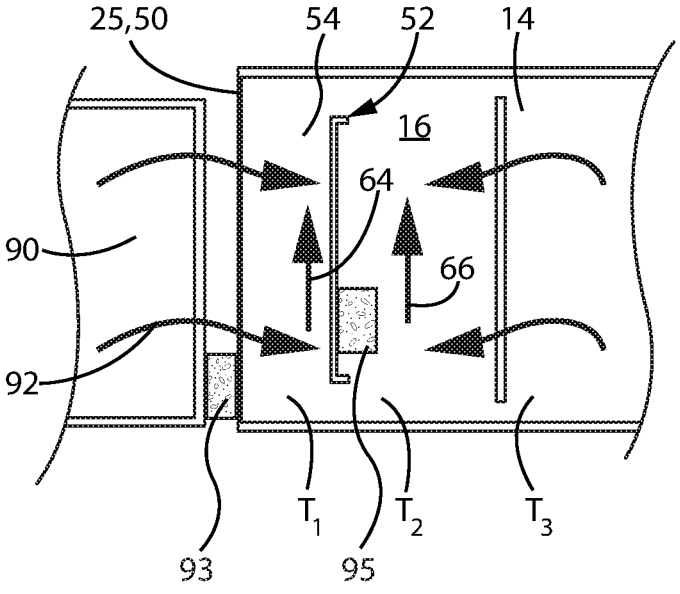
FIG. 6 is a heat flow diagram showing heat flow from an adjacent cooking element as blocked by the plenum system of the present invention.

Referring now to FIG. 6, when adjacent cooking equipment 90 (such as a fryer or another oven) generating a heat source is placed next to the sidewall 25, heat 92 from that cooking equipment 90 may be conducted or radiated through the sidewall 25. This heat 92 may be rapidly collected in the plenum stream 64 and exhausted from the equipment compartment 16 with a moderate temperature rise $T_1$ in the plenum channel 54. Additional heat passing through the plenum 52, if any, may then be collected in the equipment stream 66 which also serves to collect heat generated by the contained electrical components themselves. Generally then, the equipment compartment 16 outside of the plenum channel 54 may have a temperature $T_2$ ideally somewhat higher than $T_1$ so that there is no net heat flow into the equipment compartment 16 through the sidewall 25. Airflow through the equipment compartment 16 helps hold the temperature of the equipment compartment 16 to an acceptable limit despite heat flow from the oven compartment 14 at a much higher temperature of $T_3$.

While the invention contemplates that the plenum 52 alone, with sufficient airflow, will allow operation of the oven 10 adjacent to other cooking equipment 90 without the use of "passive" nonstructural insulation such as fiberglass batting, it will be appreciated that such additional insulation material including coatings, reflective materials, and air entraining materials may be used to augment the action of the plenum 52. For example, passive insulation material 93 may be placed on the outer surface of the sidewall 25 to resist the flow of heat 92 and to increase the separation between the oven 10 and the cooking equipment 90. In addition or instead, passive insulation material 95 may be placed on the inner surface of the plenum 52. Both of these approaches minimize interference with access to the interior of the equipment compartment 16 when the sidewall 25 is removed and minimize interference with airflow through the plenum channel 54. Additional insulating material (not shown) may also be placed unattached to the structure of the sidewall 25 in the equipment compartment 16.

Generally the "virtual insulation" provided by the plenum 52 makes it possible to eliminate nonstructural insulation such as fiberglass batting placed between the electrical components of the equipment compartment 16 and the sidewall 25 allowing improved access to the electrical components for service and the like when the sidewall 25 is removed. The moving air through the plenum channel 54 allows the thickness of the channel to be greatly reduced from the size of the external clearance that would otherwise be required between cooking equipment 90 and the sidewall 25.

It will be understood generally that one or more of the fans 44*a*-44*c* may be controlled thermostatically to reduce energy consumption when environmental conditions or site conditions do not require the fans to be on at all times.

Oven Handle with Signaling Capabilities

Figure 7:
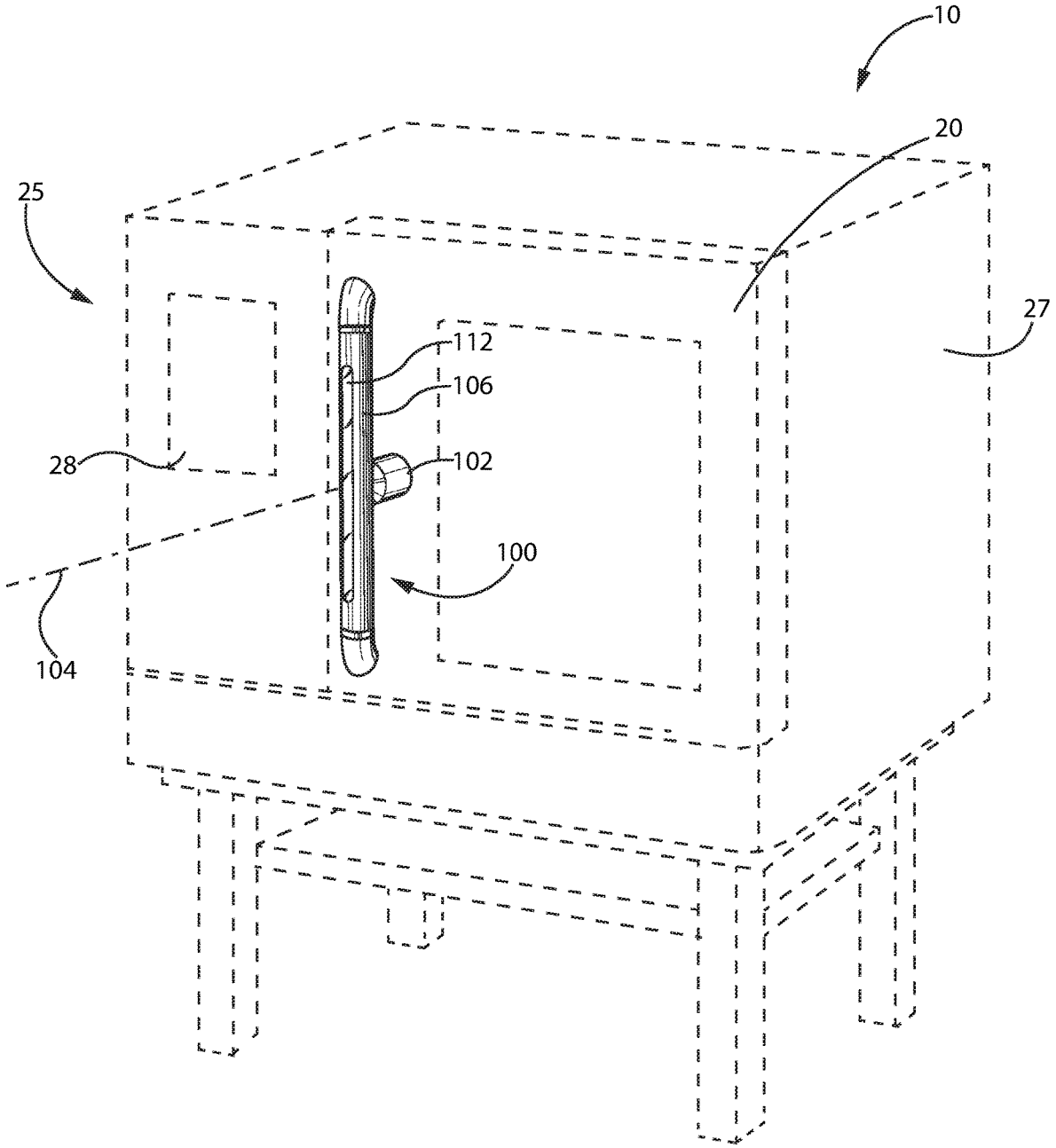
FIG. 7 is a figure similar to that of FIG. 1 showing the oven with the door closed to expose the oven door handle.
Figure 8:
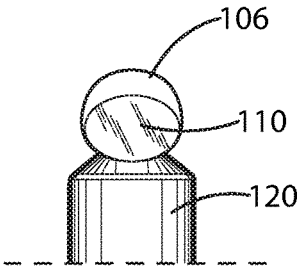
FIGS. 8, 9, 10 and 11 are top plan, rear elevational, right side elevational, and front elevational views of the handle of FIG. 6, it being understood that the left side elevational view of the handle is a mirror image of FIG. 10.
Figure 9:
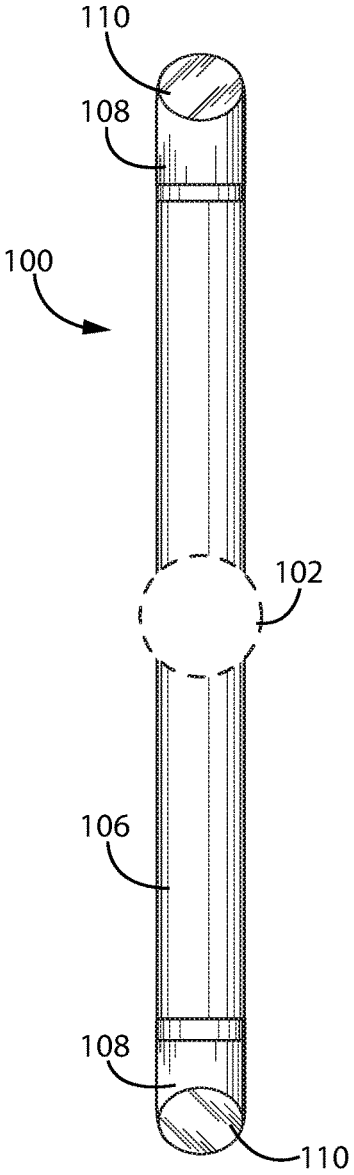
Figure 10:
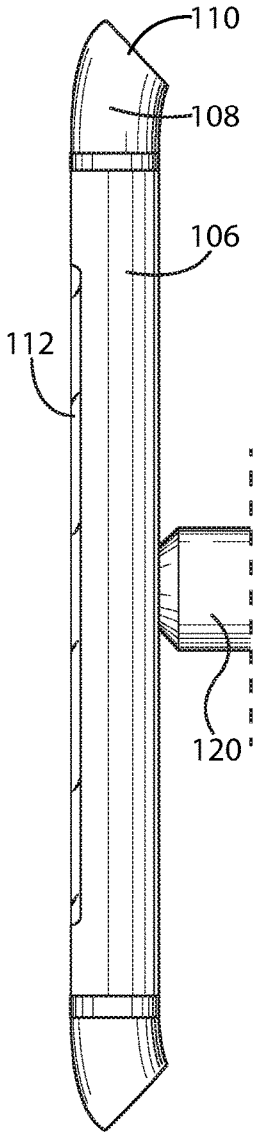
Figure 11:
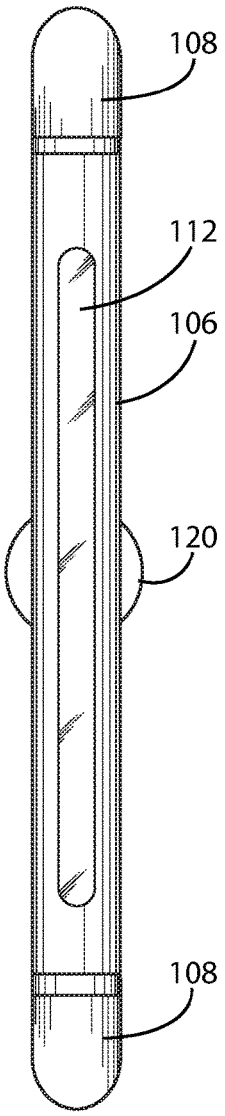

Referring now to FIG. 7, the door 20 of the oven 10 may provide for an exterior door handle 100 operating the door latching mechanism by being turned about an axis of rotation 104 generally normal to an outer surface of the door 20. The handle 100 may be attached to the door 20 by means of a shaft 102 extending along and rotating about axis of rotation 104 and communicating with the latch assembly 22 (shown in FIG. 1) to allow unlatching of the door 20 for opening as shown in FIG. 1.

Referring now generally to FIGS. 7-11, the handle 100 may provide for a generally cylindrical tubular portion 106 extending vertically and attached to the shaft 120 at right angles at about its midpoint. As so attached, the handle provides for portions extending in opposite and equal directions, for example, by approximately 8 inches from axis of rotation 104. The tubular portion 106 may have, for example, a diameter of 1½ inches and be constructed of a stainless steel metal tube.

Upper and lower ends of the tubular portion 106 may connect to capping portions 108 having a circular cross-section conforming in diameter to the ends of the tubular portion 106 at their point of attachment and arcing backward toward the door 20 to present an oblique face 110 tipped at approximately 45 degrees to axis of rotation 104.

A front facing surface of the tubular portion 106 opposite a point of attachment of the tubular portion 106 to the shaft 102 may present a translucent elongate window 112 extending along the majority of length of the tubular portion 106 in a vertical direction to be visible to a user facing the door 20.

Figure 12:
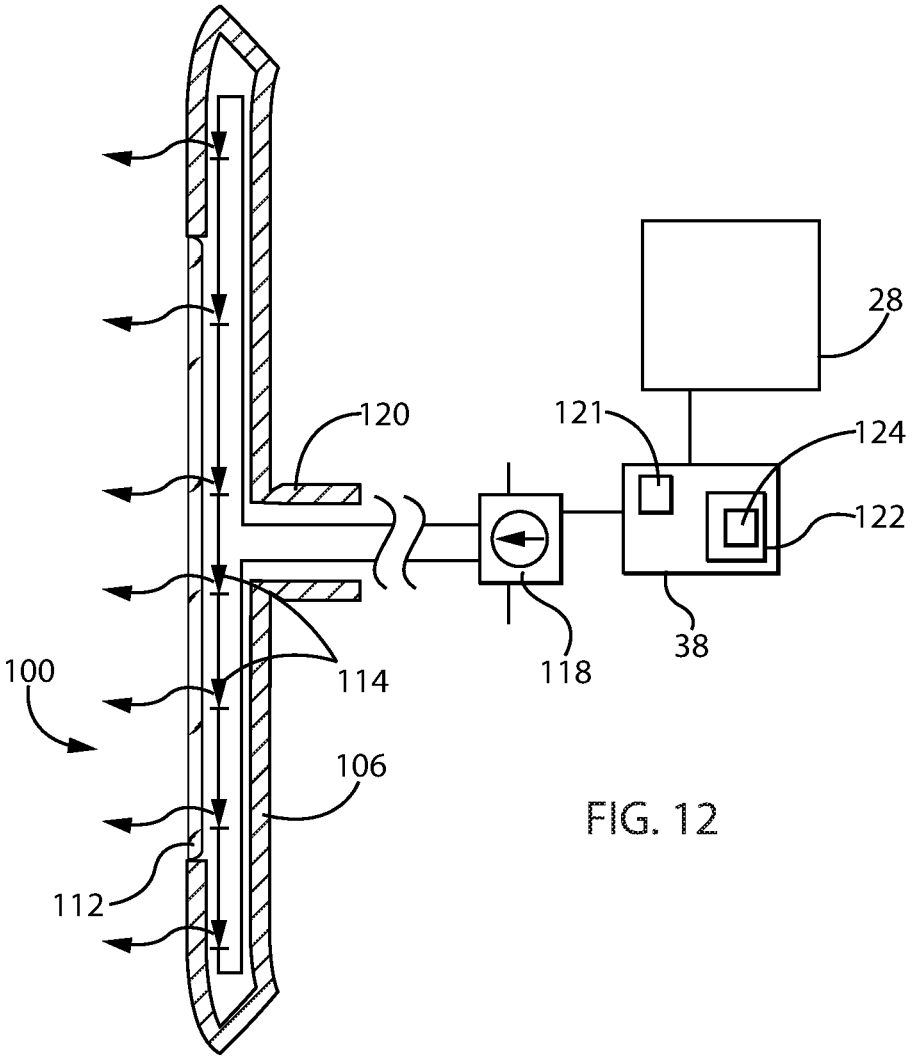
FIG. 12 is a schematic block diagram of an illumination system inside the handle of FIG. 6.

Referring now to FIG. 12, a set of light emitting diodes (LEDs) 114 may be positioned within the tubular portion 106 arrayed along the vertical axis behind the translucent elongate window 112 to present a substantially evenly illuminated bar when the light emitting diodes 114 are energized and shine through the translucent elongate window 112. In one embodiment, the light emitting diodes may be blue to present a visually unique signal that may be distinguished from other sources of light in the kitchen both by color and by dimension and orientation.

The LEDs 114 may communicate with an LED power supply 118, for example a constant current source communicating with a series connection of the LEDs 114. The LED power supply 118 may receive a control signal from the control circuit 38 to turn the LEDs 114 on and off in unison.

Figure 13:
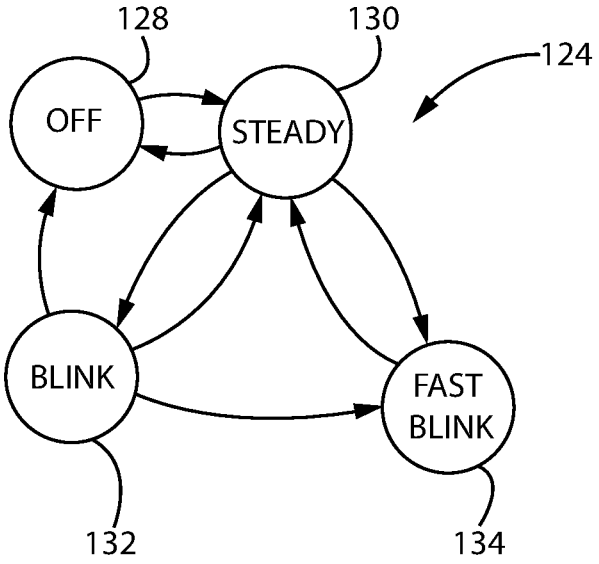
FIG. 13 is a state diagram showing control of the illumination system of FIG. 12 providing visual signals indicating the operating state of the oven.

As mentioned above, the controller circuit 38 may include a processor 121 and a memory 122 holding a stored program 124 for implementing control of the oven and of the LEDs 114 through the power supply 118. Specifically, referring also to FIG. 13, when the oven is operating to cook food, the stored program 124 may move from an off state 128 at which it initializes and where the LEDs are not illuminated, to a steady-state 130 with the LEDs illuminated with constant illumination. When the end of the cooking process is reached, for example, as determined by temperature and/or time implemented by timers and temperature monitors within the controller circuit 38, the program 124 may move to a blinking state 132 where the LEDs 114 blink in unison, for example, with a period of approximately once per second to provide a visual signal that the cooking process is complete and the oven 10 may be accessed. An error state 134 providing a fast blinking of the LEDs, for example, having a period less than one half second may be used to indicate a failure of the cooking process either reflecting an error state in the operation of the control circuit 38 or another oven-specific error such as failure to reach a given temperature within a predetermined time window.

High-Efficiency Heat Recovery System

Figure 14:
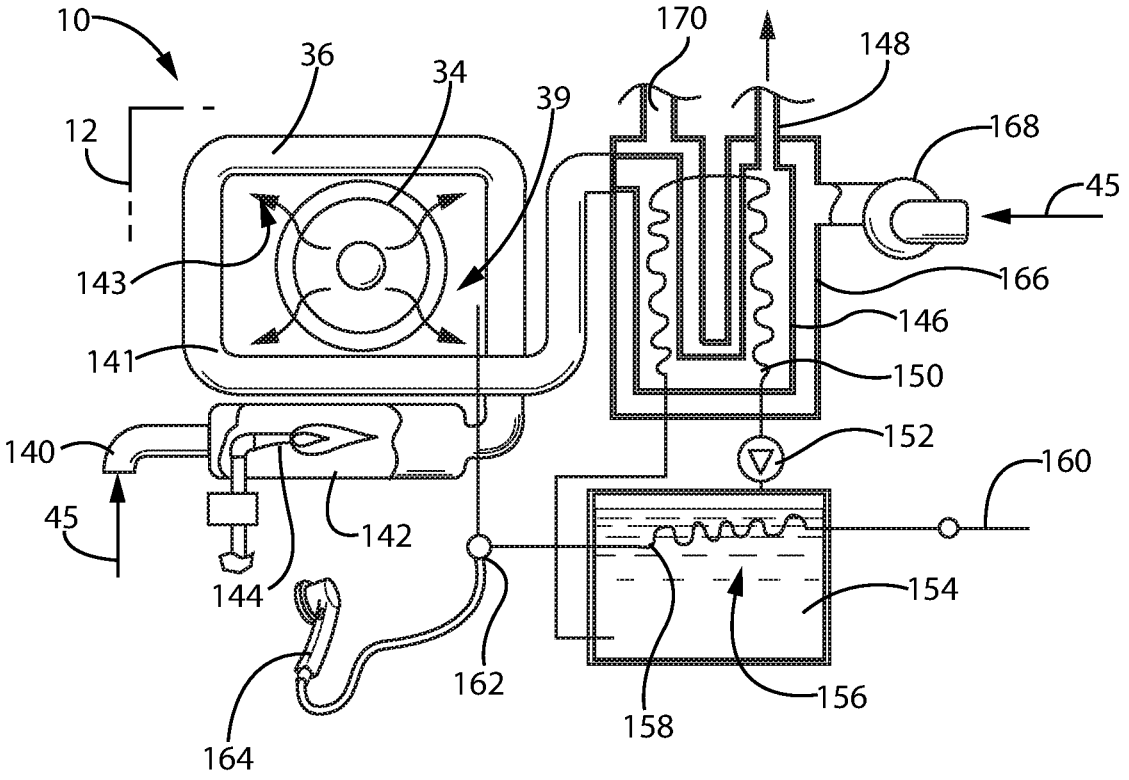
FIG. 14 is a simplified flow diagram of a heat recovery system suitable for use with the oven of FIG. 1 showing a flue gas heat exchanger and water storage unit.

Referring now to FIG. 14, the heater 36 surrounding the fan 34 may be a gas heating element providing a conduit 141 having an intake 140 receiving a source of ambient air 45 outside of the oven 10. The ambient air 45 from the intake 140 may be drawn into a combustion chamber 142 having a gas jet 144 for heating and propelling the heated gas along a conduit 141 to circulate around the fan 34 to exchange heat from the heated gas inside the conduit 141 of the heater 36 and convection air 142 circulated by the fan 34.

After one or more cycles around the fan 34, the conduit 141 may be received by an inner heat exchanger 146 before discharging through exhaust pipe 148. A water conduit 150 may pass through the heat exchanger 146. Water within the water conduit 150 is circulated by a pump 152 to receive heat from the heated gases from the combustion chamber 142 after heating the air 143 but before passing out of the exhaust pipe 148. The heat exchanger 146 thus transfers otherwise wasted heat into water in the water conduit 150, heating the water and cooling the exhausted gases to provide a lower heat load to the kitchen.

The heated water may be received within a heat storage tank 154 that is thermally insulated to hold heat therein. A secondary heat exchanger 156 is then provided by a second water conduit 158 passing through the heated water of the storage tank 154, the second water conduit 158 receiving water received from a freshwater source 160. This heated water of second water conduit 158 may pass through a valve 162 to be sent either to a spray nozzle 164 for use in cleaning the oven between cooking sessions, or to the water jet 39 where the preheated water is more readily turned into steam, saving energy in this steam conversion process. This steam is generated by further heating of the water by the heater 36 around the fan 34 then passes along with the air 142 into the cooking cavity for steam cooking as is understood in the art. It will be appreciated that the heat storage tank 154 allows heated water be generated from second water conduit 158 for the purpose of cleaning even after the oven is off.

Generally, the heat storage tank 154 includes freshwater makeup valving and overflows to keep heat storage tank 154 filled with water and to control the temperature of the contained water to less than boiling.

The inner heat exchanger 146 providing heat to the water conduit 150 may be jacketed with an outer heat exchanger 166 which is fed by air intake fan 168 receiving fresh air from outside of the oven 10 and conducting it through the heat exchanger 166 to pick up additional heat from the outside of the conduit 141 that surrounds the water conduit 150. This heated air is then received by a browning conduit 170 which may be directed, for example, inside the oven cavity toward a particular rack or multiple racks to provide for elevated temperature air suitable for producing high temperature gradients within the oven that induce browning on the surface of foods.

Figure 15:
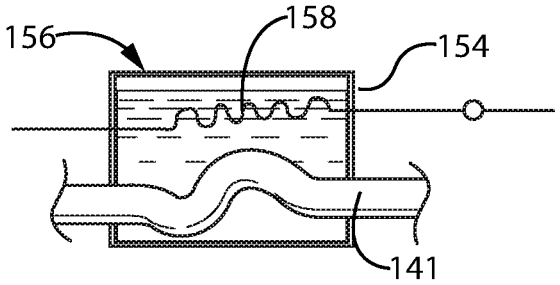
FIG. 15 is a fragmentary view of an alternative water storage unit having direct heat exchange with flue gases.

Referring now to FIG. 15, in an alternative embodiment, the heat storage tank 154 may receive the conduit 141 after it has looped about the fan 34, the conduit 141 passing directly through the tank for direct heat transfer of heat from the heated gases in the conduit 141 to the water of the storage tank 154 eliminating the need for water conduit 150 and pump 152.

Figure 16:
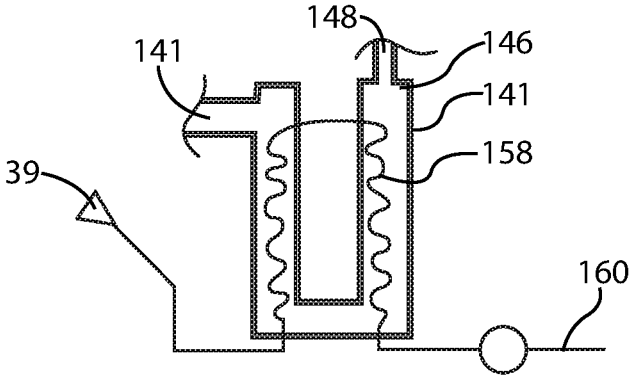
FIG. 16 is an alternative gas flow heat exchanger that does not require the water storage unit.

Referring now to FIG. 16, alternatively, the water conduit 158 may pass directly through the conduit 141 in the first heat exchanger 146 to provide direct heating of the water in that water conduit 158, for example to the water jet 39, without the need for a water storage tank during operation of the oven.

Generally the systems as described reduce the need for separate heating sources for heating water and browning air, make additional use of waste heat from the oven thereby serving to reduce kitchen heat load.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a control board" and "a processor" can be understood to include one or more microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. An oven comprising:

an oven housing having vertically extending outer side walls flanking an oven housing volume, the oven housing volume divided into side by side first and second chambers by a divider wall;

a cooking cavity positioned in the first chamber and accessible through an oven door in an open position and sealable over the cooking cavity in a closed position;

a heater and a convection fan positioned in the first chamber and communicating with the cooking cavity to heat air of the cooking cavity and circulate air in the cooking cavity;

a passive insulation in the first chamber filling a space between the cooking cavity and the vertically extending outer side wall of the first chamber;

an electronic compartment holding electronic control circuits controlling operation of the oven positioned in the second chamber;

a vertically extending plenum channel formed by a plenum sheet attached in spaced separation to the vertically extending outer side wall of the second chamber;

a fan located near a bottom of the electronic compartment pulling fresh intake air through an air inlet opening of the bottom of the electronic compartment and through the electronic compartment along a first path of air through the vertically extending plenum channel distinct from a second path of air through the electronic compartment from the air inlet opening of the electronic compartment to an exhaust opening of the electronic compartment not through the vertically extending plenum channel;

a second fan located near a top of the electronic compartment to exhaust air out of the top of the electronic compartment;

an air restrictor plate separating the electronic compartment into an upper portion and a lower portion and providing a set of perforations through which the second path of air may flow through the air restrictor plate of the electronic compartment and into an exhaust opening wherein the first path of air bypasses the air restrictor plate thereby encouraging air flow through the vertically extending plenum air channel; and an electric motor positioned within the second chamber and communicating with the convection fan to operate the convection fan;

whereby when the oven is placed next to a second heat producing oven, the first path of air through the vertically extending plenum air channel scavenges heat entering the vertically extending outer side wall of the second chamber.

2. The oven of claim 1 wherein the air inlet opening is located at a bottom of the electronic compartment and the exhaust opening is located at a top of the electronic compartment to provide for convection reinforced airflow.

3. The oven of claim 1 wherein the first path of air and second path of air are exclusive of a grease filter.

4. The oven of claim 1 wherein the vertically extending outer side wall of the first chamber is exclusive of a plenum sheet.

5. The oven of claim 1 further including airflow restrictors interfacing with the plenum sheet for guiding air through the vertically extending plenum channel.

6. The oven of claim 1 further including a third fan located near the front top of the electronic compartment to draw air into the front top of the electronic compartment and wherein the second fan is positioned near a rear top of the electronic compartment.

7. The oven of claim 1 wherein the vertically extending outer side wall of the second chamber is removable for access to the electronic compartment by releasable fasteners.

8. The oven of claim 7 wherein the vertically extending outer side wall of the second chamber is a metal sheet and the plenum sheet forming the vertically extending plenum channel is attached to an inner surface of the vertically extending outer side wall of the second chamber.

9. The oven of claim 7 wherein the vertically extending outer side wall of the first chamber is non-removable from the oven housing.

10. The oven of claim 1 wherein the electronic compartment is free from nonstructural insulating material between the electronic compartment and the vertically extending outer side wall of the second chamber.

11. The oven of claim 1 wherein the electronic compartment includes plumbing and a valve system for controlling water for a generation of steam in the cooking cavity.

12. The oven of claim 1 wherein the electronic compartment includes a microprocessor executing a program held in a memory for operation of the oven.

13. The oven of claim 1 further including a second heat producing oven having a housing abutting the vertically extending outer side wall of the second chamber.

14. The oven of claim 13 further including a third heat producing oven having a housing abutting the vertically extending outer side wall of the first chamber.

15. The oven of claim 1 further including a stand supporting an entire bottom wall of the oven housing.

16. The oven of claim 1 wherein the cooking cavity has opposed side walls with rack supports for holding horizontally extending cooking racks.

* * * * *